US005102116A

United States Patent [19]

Garavuso

[11] Patent Number: 5,102,116

[45] Date of Patent: Apr. 7, 1992

[54] FRICTION RETARD FEEDER WITH A CONCAVE RETARD PAD

[75] Inventor: Gerald M. Garavuso, Macedon, N.Y.

[73] Assignee: Xerox Corporation, Stamford, Conn.

[21] Appl. No.: 429,231

[22] Filed: Oct. 30, 1989

Related U.S. Application Data

[63] Continuation-in-part of Ser. No. 289,116, Dec. 23, 1988, abandoned.

[51] Int. Cl.[5] ..... B65H 3/52

[52] U.S. Cl. ..... 271/121

[58] Field of Search ..... 271/121, 117, 10, 35, 271/258, 104, 122, 123, 124, 125, 137, 167

[56] References Cited

U.S. PATENT DOCUMENTS

| | | | |
|---|---|---|---|
| 3,539,179 | 11/1970 | Bergman | 271/39 |
| 4,216,952 | 8/1980 | McInerny | 271/10 |
| 4,346,879 | 8/1982 | Ruenzi | 271/121 |
| 4,500,084 | 2/1985 | McInerny | 271/35 |
| 4,555,103 | 11/1985 | Larson | 271/121 X |
| 4,565,361 | 1/1986 | Tanaka et al. | 271/121 X |
| 4,660,822 | 4/1987 | Winkler et al. | 271/121 X |
| 4,667,244 | 5/1987 | Ishikawa | 358/294 |

FOREIGN PATENT DOCUMENTS

| | | | |
|---|---|---|---|
| 2588536 | 4/1987 | France | 271/121 |
| 13039 | 1/1982 | Japan | 271/121 |
| 244734 | 12/1985 | Japan | 271/121 |
| 1529694 | 10/1978 | United Kingdom . | |

*Primary Examiner*—David H. Bollinger
*Attorney, Agent, or Firm*—William A. Henry, II

[57] ABSTRACT

A document handling apparatus includes a friction retard feeder for feeding documents from a stack. The friction retard feeder has a feed roll and a concave surfaced retard pad that inhibits stubbing of documents during feeding.

4 Claims, 2 Drawing Sheets

FRICTION RETARD FEEDER WITH A CONCAVE RETARD PAD

This application is a continuation-in-part application of copending application Ser. No. 07/289,116, filed Dec. 23, 1988, now abandoned. The entire disclosure of copending application Ser. No. 07/289,116 is incorporated herein by reference.

Copending and commonly assigned U.S. application Ser. No. 07/202,348 by Ernest L. Dinatale et al. filed June 6, 1988, now U.S. Pat. No. 4,884,794, and entitled Duplex Document Handler is hereby cross referenced and included herein by reference.

This invention relates to a paper feeder for an apparatus for recording images, data and the like on paper, hereinafter referred to as a recording apparatus, and more particularly to a friction retard feeder having a concave retard pad for such an apparatus.

To date, most friction retard feeders use a friction belt to feed sheets of paper and a retard roll or belt to inhibit multiple sheet feeds. In either application, the friction belt is made to wrap around the retard roll or belt through some nip wrap angle. The retard surface has almost always been convex and supported from behind by a solid effectively incompressible member such as the roller in, e.g., United Kingdom Patent Specification 1,529,694. In separation of a three page slug, for example, the retard material at the lead edge of the slug may be compressed since this is the focal point of a local peak in nip pressure. Compliance of the retard material will determine how much of the wrap angle is needed in front of a sheet stack before the belt returns to an uncompressed state. Assume that the slug breaks above the third and below the second sheet, the third sheet will stop while sheets one and two continue to move. As the two top sheets cantilever over the stalled sheet, they are bent around the distributed load of the feed belt. It is essential that no further separation is possible until the slug (sheets one and two) again make contact with the retard material. This requires bending of the slug to a curvature greater than the nip curvature and/or high compliance of the retard material which will alow the retard surface to rise to the slug. Most friction retard feeders make use of both of these mechanisms by placing strict specifications on feed belt tension and retard compliance by still requiring long nips to effect separation of large slugs.

An improvement over these types of friction retard feeders is shown in U.S. Pat. Nos. 4,216,952 and 4,500,084 each of which includes a feed roll and a concave retard belt that allows belt tension and retard material compliance to be reduced to smaller significance levels. However, a problem with this type of friction retard feeder is that stubbing occurs in the nip between the retard roll and the retard belt. This is especially significant when curled sheets are fed.

Other relevant prior art includes U.S. Pat. Nos. 3,539,179; 4,346,879; 4,555,103, and 4,667,244 as well as Japanese Publications 57-13039 and 60-244734. In U.S. Pat. No. 3,539,179, a paper currency counting machine is disclosed that has a feed runway that mates with a feed roll in order to feed single bills from a stack. U.S. Pat. No. 4,346,879 is directed to a mechanism for feeding documents to a copying apparatus which has separating plates that cooperate with separating rolls to feed single documents. A bottom sheet feeder is shown in U.S. Pat. No. 4,555,103 that employs an endless feed belt and a retard pad to separate single sheets from a stack. The feeder includes an inclined lead surface plate that sheets in the stack are driven against. A paper feeding device that includes a friction retard member with a concaved portion and a paper separating roll is disclosed in U.S. Pat. No. 4,667,244. Japanese reference 57-13039 is directed to an automatic paper feeder that enables a friction member to come in uniform contact with a paper feeding roller by utilizing resilient force of a resilient plate itself. The Ricoh reference 60-244734 is directed to preventing the overlapped feeding of sheets by use of a separating roll and an adjustable rubber plate. The rubber plate touches the separating roll and an adjustable plate pushes against the rubber plate upstream of the separation section between the rubber plate and separating roll.

Accordingly, a solution to the problem of stubbing that occurs in the nip between a retard roll and belt is disclosed that includes the use of a concave retard pad in cooperation with a feed roll or belt in order to inhibit stubbing of curled sheets.

The above-mentioned features and others of the invention, together with the manner of obtaining them, will best be understood by making reference to the following specification in conjunction with the accompanying drawings, wherein.

Figure 1:
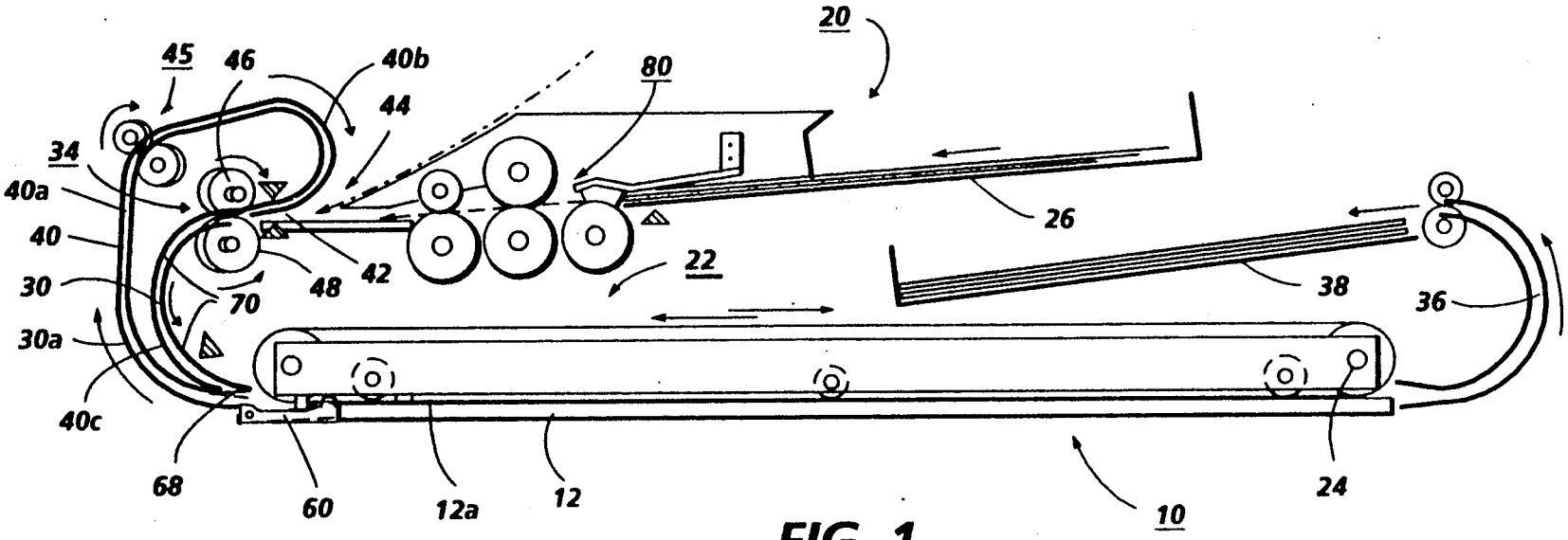
FIG. 1 is a schematic elevational view showing an electrophotographic recording apparatus employing the friction retard feeder with a concave retard pad of the present invention.
Figure 2:
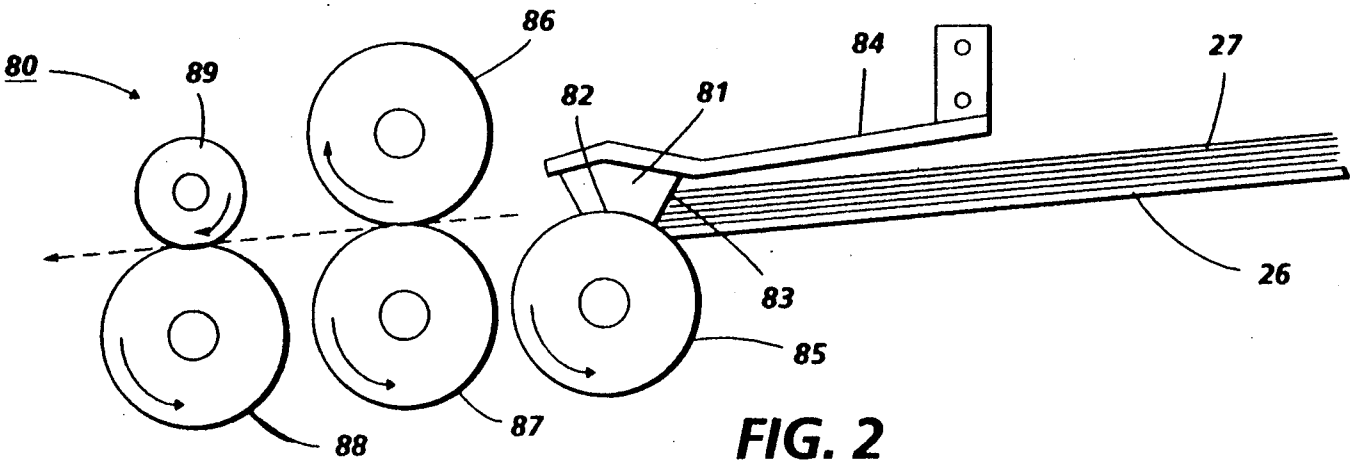
FIG. 2 is a partial elevational view of the friction retard feeder with a concave retard pad of the present invention as shown in FIG. 1.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawings. In the drawings, like reference numerals have been used throughout to designate identical elements.

By way of background description of a suitable copier with which this duplex document handling system (DDHS) may be used, there is noted Xerox Corporation U.S. Pat. No. 4,708,462 on Dual Mode Duplexing issued to Denis J. Stemmle. It discloses a copier which can select between immediate (direct loop path) duplexing or conventional duplex buffer tray (stack) duplexing, for optimizing duplex copying under various conditions (set size, sheet size, etc.). It should also be apparent that the present invention can be used with any sheet feeding system.

Referring to the DDHS example of FIG. 1, it will be appreciated that the system described herein may be utilized with various other document handlers, and with almost any copier, including various of those incorporated by reference herein. Thus the only portion of an exemplary copier 10 which need be illustrated here is the copier platen 12.

In the exemplary DDHS system 20 disclosed here all modes of operation utilize the same trays and feeders, including platen document transport 22 and its drive (preferably comprising a stepper or servo motor 24 with encoder). Components may also be shared with a recirculating document handling (RDH) mode of operation of this document handler. All documents to be copied by the copier 10 are sequentially fed to the platen 12 by the DDHS 20 where they are driven over platen surface 12*a* into a desired copying registration position by the platen transport 22 with its drive 24, and then ejected by that belt transport system 22 from the platen 12. For all modes, including recirculating (precollation) document copying, the set of original documents may be initially loaded stacked faceup into the document tray 26. They are sequentially fed out from the bottom of the stack by the sheet separator/feeder 80 of the present invention in all modes.

Figure 4A:
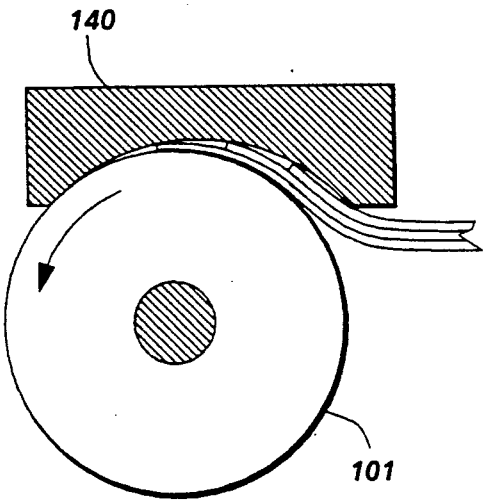
FIGS. 4A and 4B are enlarged partial side views of the friction retard feeder of the present invention showing sheets shingled from a slug of sheets.
Figure 4B:
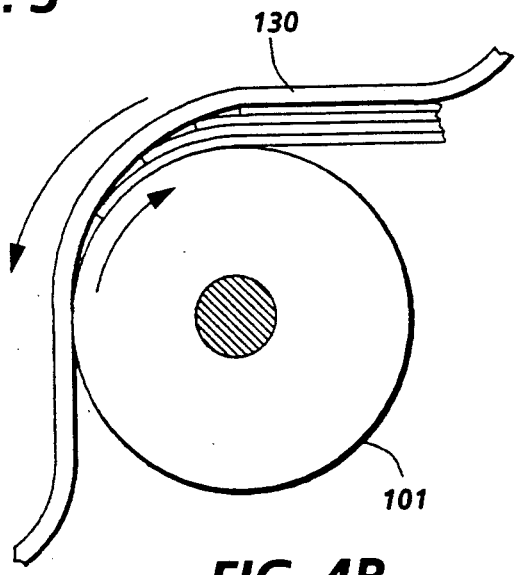

Referring particularly to FIG. 1, all document sheets 27 are initially fed downstream from the tray 26 through a simplex path 30 to the acquisition entrance to the belt transport system 22, adjacent the platen 12. The tray 26 overlies the platen, and the path 30 conventionally provides the shortest possible path connection. The simplex path 30 has a single "C" shaped inversion inverting segment 30*a*. Thus the documents are turned over once before being presented to the platen. As will be described later herein, the initial portion of this simplex path 30, (just downstream of the separator/feeder 80, at the end of tray 28 and upstream of the inverting segment 30*a*) includes a side edge registration and deskewing system 34, which may be a known crossed-rolls edge guide system. The separator/feeder 80 of the present invention comprises a cantilever mounted retard pad 81 that has a concave surface portion 82 adjacent a convex portion of feed roller 85 which separates document sheets 27 from stack 26. A slanted surface portion 83 of pad 81 is positioned adjacent document sheets 27 for shingling purposes. Retard pad 81 is loaded against feed roller 85 by gravity, however, a lightweight spring spring could be attached to the cantilever member 84, if desired. The configuration of the concave retard pad serves to prevent or minimize stubbing of document sheets since it in conjunction with feed roller 85 presents a solid nip to document sheets 27 as they are separated from tray 26. Additionally, the concave retard pad 81 limits the number of sheets that can enter the nip and applies normal and consequent frictional separating forces before the sheets reach the nip formed between retard pad 81 and separation roller 85. The concaved surface of the retard pad allows control over the throat of the nip since the retard pad radius and the feed roll radius are specified separately and independent of each other. The same retard force is applied by the concave retard pad and feed roller as is applied by a belt 130 and feed roller 101 as seen in FIG. 4B with the belt running in the opposite direction as the feed roller, however the retard pad 81 is much cheaper. Another advantage of this retard pad over a belt is that the retard pad allows much greater control of normal force because it is not belt tension dependent.

Figure 3:
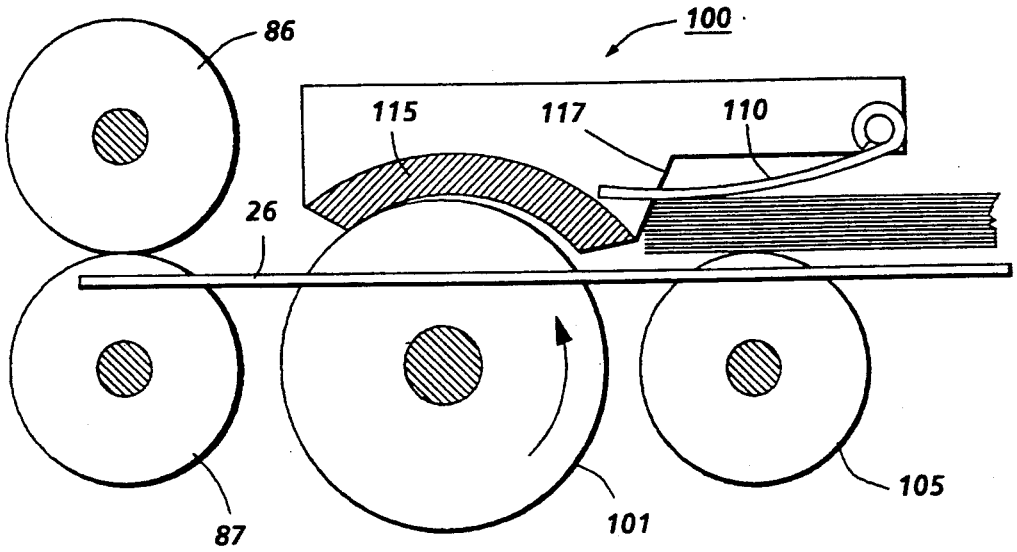
FIG. 3 is an alternative friction retard feeder that includes a nudger roll and a stack normal force ski.

An alternative feeder 100 to the retard pad and feed roller of FIG. 1 is shown in FIG. 3 and includes a nudger roll 105 and a pivoting nudger ski 110 situated before a retard pad 115 and retard ski 117. The nudger ski is positioned on top of the sheet stack and adjacent retard ski or slanted wall 117 of the retard pad. The radii of the feed and nudger rollers are 12 mm and 16 mm, respectively, but feed roller radius of up to approximately 25 mm will provide similar or better performance. The radius of the retard member is 19 mm. This must be increased as the radius of the feed roller is increased. For a 25 mm feedroller radius, a retard radius of 28 mm would be desirable. The retard pad edge can project lower than the ski so that a retarding force will accompany any normal force in this area. The nudger roll in combination with the normal force ski is used to drive one or more sheets into the feed roll/retard pad nip where frictional retarding force is applied to shear any multiple sheets from the sheet being fed. The concave shape of the retard pad brings the retard material into contact with the slug of paper or sheets in the nip without having to deflect the cantilevered lead edge of the slug. As each sheet is shingled from the slug as shown in FIG. 4A and in belt form in FIG. 4B the narrowing wedge quickly closes on the remaining sheets. Slug stiffness only helps to promote the process. The fact that the sheet wraps around the feed roller while in tension provides a capstan effect. The result is a greater effective normal force on the feed roller than on the retard pad surface allowing lower normal force without inducing more misfeeds. The sheet tension is provided by the fact that the nudger roller runs slightly slower than the feed roller to avoid placing the sheet in compression which can result in accordion jams.

Figure 5:
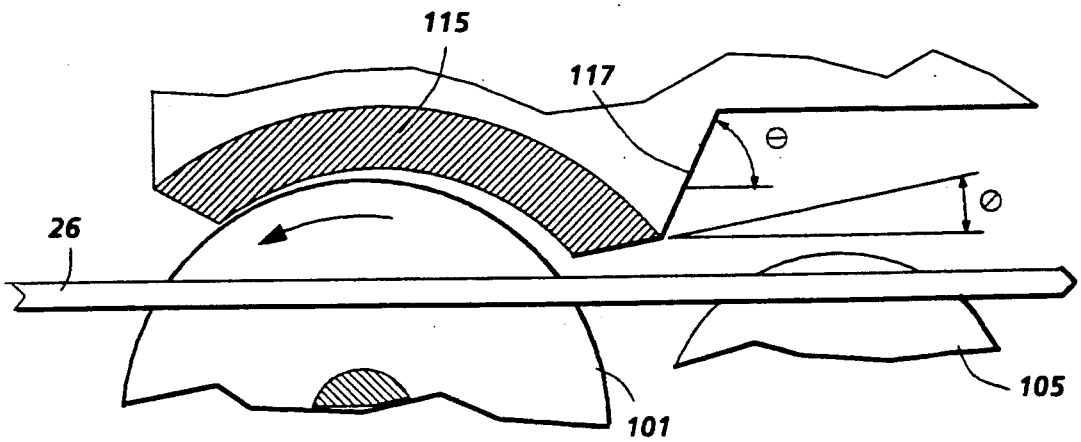
FIG. 5 is an enlarged partial side view of the friction retard feeder of FIG. 3 showing preferred slants of the retard pad and retard ski of the present invention.

The nudger, retard and feed rolls should be made of a high friction material. Also, the most sensitive area of this feeder is the entrance to the retard nip as shown in FIG. 5. It is important that as a sheet contacts the retard ski 117, the combination of the ski friction and the angle $\theta$ of the retard ski with respect to a horizontal plane not create a stubbing condition. This means that a ski friction of approximately 0.4 will tolerate an angle $\theta$ as steep as 65° without causing stubbing of even upcurled sheets. As the sheet progresses to the retard pad, the same requirement holds so that a retard friction of 1.6 limits the angle $\phi$ to about 25°. It is desirable to have the retard pad project lower than the ski so that a retarding force will accompany any normal force in this area. The gap between the retard pad and the tray is preferably between 1 and 2 mm, but gaps somewhat larger may not cause difficulty. Preferably, the feed roll 101 surface speed is about 400 mm/sec and the nudger 105 surface speed is approximately 390 mm/sec. The take away roll speed is arbitrary provided it is greater than the feed roll speed. The height of the top of feed roll 101 above tray 26 is about 3 mm, however, this height should be maximized to generate the longest nip and the greatest separating capability. This device handles a wide variety of copy sheets weight and sizes with equal ease.

The DDHS unit 20 may be utilized as a non-recirculating automatic document feeder (ADF) by placing the documents in tray 26 but not returning them to the tray 26 after copying, or by only circulating them once. After copying, documents in the ADF version of FIG. 1 may be ejected, as shown, from the opposite, downstream, end of the platen into an output inverting path 36 which inverts the documents and ejects them up into an output restacking tray 38. The tray 38 here is also spaced above the platen and the belt transport system 22, but is partially underlying the tray 26, for overall compactness of the DDHS 20. The inverting path 36 provides restacking of the documents in the same collated order in which they were initially stacked in tray 26.

If the documents are duplex documents requiring inversion, they are inverted in a duplex path 40. The duplex path 40 here is a continuous unidirectional but non-circular loop which starts and ends at the same side of the platen. The duplex path 40 includes, in order, two inverting segments 40*a* and 40*b* and the single inversion inverting segment 30*a* of the simplex path 30. The duplex path 40 smoothly merges into the simplex path 30 at a path intersection 42 upstream of the edge registration and deskewing system 34 but downstream of the separator/feeder 28. At the intersection 42 each duplex document has been turned over twice from its orientation coming off the platen, and is feeding in the downstream direction into the simplex path 30, i.e., in the same feeding direction as a document being initially fed from the tray 26, as shown by the dashed arrow in FIG. 1. An alternate single sheet bypass input 44 may also be provided there as shown by the illustrated dot-dash arrow. All three said paths 30, 40, 44 are entering the side edge registration and de-skewing system 34, and may also use the same sensor, shown there schematically as a solid diamond. All three paths are common at this point, and moving in a common direction into the edge registration and de-skewing system 34. The system 34 here includes fixed-position cross-rolls 46 and 48 acting on the document sheet near one edge. Thus the same edge registration and de-skewing mechanism and mode of operation, and then the rest of the simplex path 30, can be used for all modes of operation and all documents.

Desirably, the duplex path 40 in segment 40*a* or 40*b* also includes a set of sheet feed rolls 45 oppositely skewed to drive the duplex documents therein sideways, but oppositely to the side registration movement direction of the side edge registration and de-skewing system 34, as well as forward. Thus the duplex documents are provided an appropriate transverse entry position for entry into the side edge registration and de-skewing system 34, and reduced edge drag.

I claim:

1. A friction retard sheet feeding apparatus for feeding sheets from a stack including a feed roll for separating sheets from the stack; and retard means for inhibiting multifeeding of sheets from the stack, said retard means being non-adjustable and having a concave retard surface first portion adjacent said feed roll; and wherein said retard means includes a second portion in the form of a retard ski that extends below a line tangent to the uppermost surface of said feed roll that is adjacent said retard means so that a retarding force will be created on sheets fed thereagainst, and wherein said retard ski is positioned immediately adjacent to and adapted to be contacted by sheets in the stack as they are fed from the stack; and wherein said retard ski comprises a slanted wall portion adjacent a copy sheet support surface, said wall portion being positioned at an angle of approximately 25° with respect to said copy sheet support surface.

2. The friction retard sheet feeding apparatus of claim 1, including a nudger ski positioned upstream of said retard means.

3. The friction retard sheet feeding apparatus of claim 1, wherein said retard ski is positioned at an angle of approximately 65° or less with respect to a horizontal plane.

4. The friction retard sheet feeding apparatus of claim 1, wherein said feed roll has a portion thereof protruding about 3 mm above said copy sheet support surface.

* * * * *